US011293266B2

(12) United States Patent
Bowman

(10) Patent No.: US 11,293,266 B2
(45) Date of Patent: Apr. 5, 2022

(54) AUTONOMOUS SYSTEMS AND METHODS FOR WELLBORE INTERVENTION

(71) Applicant: Expro North Sea Limited, Aberdeen (GB)

(72) Inventor: David Sydney Bowman, Lound (GB)

(73) Assignee: Expro North Sea Limited, Dyce (GB)

( * ) Notice: Subject to any disclaimer, the term of this patent is extended or adjusted under 35 U.S.C. 154(b) by 75 days.

(21) Appl. No.: 16/641,863

(22) PCT Filed: Aug. 24, 2018

(86) PCT No.: PCT/GB2018/052407
§ 371 (c)(1),
(2) Date: Feb. 25, 2020

(87) PCT Pub. No.: WO2019/038557
PCT Pub. Date: Feb. 28, 2019

(65) Prior Publication Data

US 2020/0224515 A1 Jul. 16, 2020

(30) Foreign Application Priority Data

Aug. 25, 2017 (GB) ..... 1713714

(51) Int. Cl.

| | |
|---|---|
| ***E21B 37/00*** | (2006.01) |
| ***E21B 33/076*** | (2006.01) |
| ***E21B 19/22*** | (2006.01) |
| ***E21B 23/14*** | (2006.01) |
| ***E21B 33/072*** | (2006.01) |
| *E21B 21/10* | (2006.01) |

(52) U.S. Cl.
CPC ..... *E21B 37/00* (2013.01); *E21B 33/076* (2013.01); *E21B 19/22* (2013.01); *E21B 21/103* (2013.01); *E21B 23/14* (2013.01); *E21B 33/072* (2013.01)

(58) Field of Classification Search
CPC ..... E21B 37/00; E21B 33/076; E21B 33/072; E21B 21/103; E21B 23/14; E21B 44/02
See application file for complete search history.

(56) References Cited

U.S. PATENT DOCUMENTS

| | | | | |
|---|---|---|---|---|
| 9,109,419 | B2 * | 8/2015 | Fenton | E21B 33/043 |
| 2004/0094305 | A1 | 5/2004 | Skjærseth | |
| 2005/0217844 | A1 | 10/2005 | Edwards | |
| 2006/0054316 | A1 * | 3/2006 | Heaney | E21B 33/124 166/250.01 |
| 2009/0211760 | A1 | 8/2009 | Richards | |
| 2011/0094749 | A1 | 4/2011 | Richards | |

(Continued)

*Primary Examiner* — Aaron L Lembo
(74) *Attorney, Agent, or Firm* — Getz Balich LLC

(57) ABSTRACT

An autonomous intervention system configured to perform an intervention operation in a wellbore comprises a tool housing having a tool storage compartment configured to house an intervention tool. A valve arrangement permits selective communication of tools and fluid between the tool housing and the wellbore. The intervention system is configured to move in response to an activation event between a tool storage configuration in which the tool housing is isolated from the wellbore by the valve arrangement and an activated configuration in which the valve arrangement is open and the tool housing communicates with the wellbore to permit deployment of the intervention tool by a tool deployment arrangement.

19 Claims, 9 Drawing Sheets

(56) References Cited

U.S. PATENT DOCUMENTS

| | | | | |
|---|---|---|---|---|
| 2013/0032407 | A1* | 2/2013 | Edbury | E21B 47/003 175/61 |
| 2013/0138254 | A1* | 5/2013 | Seals | E21B 7/068 700/282 |
| 2017/0204702 | A1 | 7/2017 | Hansen | |
| 2017/0260817 | A1* | 9/2017 | Dobkins | E21B 44/02 |
| 2017/0292327 | A1* | 10/2017 | Reckmann | G06F 30/23 |
| 2018/0209235 | A1* | 7/2018 | Creighton | E21B 47/13 |
| 2018/0209236 | A1 | 7/2018 | Talgø | |
| 2018/0266234 | A1* | 9/2018 | Witte | E21B 19/22 |
| 2019/0203575 | A1* | 7/2019 | Schlosser | B66D 1/505 |
| 2020/0011141 | A1* | 1/2020 | Wijning | E21B 19/006 |
| 2020/0183040 | A1* | 6/2020 | van der Ende | G01V 1/40 |
| 2020/0270978 | A1* | 8/2020 | Dobkins | E21B 19/22 |
| 2020/0362687 | A1* | 11/2020 | Hopwood | E21B 4/02 |
| 2021/0025267 | A1* | 1/2021 | Christie | E21B 43/26 |

* cited by examiner

AUTONOMOUS SYSTEMS AND METHODS FOR WELLBORE INTERVENTION

This application claims priority to PCT Patent Appln. No. PCT/GB2018/052407 filed Aug. 24, 2018, which claims priority GB Patent Appln. No. 1713714.2 filed Aug. 25, 2017, which are herein incorporated by reference.

BACKGROUND OF THE INVENTION

1. Technical Field

This relates to autonomous systems and methods for wellbore intervention.

2. Background Information

In the oil and gas industry, well boreholes ("wellbores") are drilled in order to access subsurface hydrocarbon-bearing formations. In order to control production from a given wellbore, a valve arrangement known as a Christmas tree is typically disposed on the wellhead, the valve arrangement comprising a number of flow control valves and safety valves configured amongst other things to control production, permit well isolation and control access of downhole tools and equipment into/from the wellbore.

During the operational life of a given well, it may be necessary to access the wellbore in order to perform remedial operations, known generally in the industry as intervention or workover operations.

However, while necessary, intervention operations pose a number of challenges for operators. For example, wellbores may be located in remote or relatively inaccessible locations, making them difficult and time consuming to access, particularly for intervention operations which require significant man-power to operate and/or which require equipment which by virtue of size or weight may be restricted or prevented by local infrastructure laws. Wellbores may also be located in areas of particular scientific or environmental sensitivity. The given location may also pose challenges in terms of how to protect the environment, intervention equipment and personnel.

An operator may wish to carry out intervention operations a number of times in order to mitigate deferred production or otherwise maintain production at optimal levels. One such intervention operation involves the removal of paraffin wax, asphaltenes and/or other solids, residues and the like which can accumulate in the wellbore over time and which reduce production or otherwise reduce the optimal operation of the well. In some instances, a given field may include a significant number of wells, some fields having hundreds of wells, making intervention operations difficult and in some cases prohibitively expensive to carry out regularly given the above factors and demands on personnel and equipment.

SUMMARY OF THE INVENTION

According to a first aspect, there is provided an autonomous intervention system for a wellbore, the intervention system comprising: a tool housing configured to house an intervention tool for deployment into the wellbore; a tool deployment arrangement for deploying the intervention tool into the wellbore, wherein the intervention system is configurable between a tool storage configuration in which the tool housing is isolated from the wellbore and an activated configuration in which the tool housing communicates with the wellbore and permits deployment of the intervention tool by the tool deployment arrangement; and a controller configured to permit autonomous control of operation of the intervention system between the tool storage configuration and the activated configuration to facilitate deployment of the intervention tool into the wellbore.

Beneficially, embodiments of the intervention system permit wellbore integrity to be managed and production maintained safely and efficiently while at the same time permitting intervention operations, such as paraffin wax cleaning operations for example, to be carried out autonomously. Moreover, embodiments of the intervention system may reduce the environmental impact on the surrounding environment, for example reducing the requirement for large and heavy vehicles; reduce carbon emissions, and noise. Vehicle fleet management and personnel costs may also be reduced. The system may be configured to operate automatically and independently of any manual intervention, and configured to deploy specialist tools or tooling, for example to prevent solids build up, gather data or reconfigure a wellbore completion, saving costs, reducing health and safety and optimizing or at least improving production up-time.

In use, the intervention system may be configured to provide selective communication between the tool housing and the wellbore to permit deployment of the intervention tool into the wellbore by the tool deployment arrangement. The intervention system may permit a plurality of intervention operations to be carried out on the wellbore.

In particular embodiments, the intervention system may comprise a permanent installation. By providing a permanent installation the intervention system may be stationed during construction and/or commissioning of the wellbore and may be retained in place for the operational life of the wellbore; obviating or at least mitigating the need to transport intervention equipment to site and thereby minimizing disruption to the local environment, wildlife and infrastructure.

Alternatively, the intervention system may comprise a semi-permanent installation. For example, the intervention system may be retained in place for one or more phases of the operational life of the wellbore.

The intervention system may be configured to automatically move between the tool storage configuration and the activated configuration.

The intervention system may also or alternatively be configured to move in response to a control command from an operator. Beneficially, embodiments of the intervention system permit autonomous operation while also permitting manual intervention where required.

The controller may be configured to activate the intervention system in response to a given activation event. The activation event may be pre-determined.

The activation event may take a number of different forms.

The activation event may relate to fluid flow.

The fluid flow rate may comprise production flow rate for example.

In particular embodiments, the activation event may comprise a fluid flow rate dropping below a selected threshold. The intervention system may for example be configured to activate in response to the production flow rate from the well dropping below a threshold in order to increase production from a well. Beneficially, such operations can be carried out autonomously and without the requirement to repeatedly transport personnel and equipment to/from site, reducing the costs and challenges associated with the intervention operation and environmental impact on the surrounding environment, wildlife and infrastructure.

The activation event may comprise a fluid flow rate reaching or exceeding a selected threshold.

The activation event may comprise a fluid flow rate decrease.

The activation event may comprise a fluid flow rate dropping below a selected threshold.

The activation event may comprise a time event. For example, the intervention system may be configured to activate after a selected time has elapsed, or at a given time of day. Beneficially, embodiments of the intervention system may permit an intervention operation schedule to be implemented autonomously and without the requirement to repeatedly transport personnel and equipment to/from site, reducing the costs and challenges associated with the intervention operation and environmental impact on the surrounding environment and wildlife.

The activation event may comprise a pressure event.

The pressure event may comprise a differential pressure.

In particular embodiments, the activation event may comprise a pressure, such as differential pressure, reaching or exceeding a selected threshold.

In some embodiments, the activation event may comprise a pressure, such as differential pressure, dropping below a selected threshold.

The activation event may comprise a temperature event.

In particular embodiments, the activation event may comprise a temperature reaching or exceeding a selected threshold.

In some embodiments, the activation event may comprise a temperature dropping below a selected threshold.

The intervention system may be activated in response to a single activation event or a plurality of activation events, for example, but not exclusively, one or more of the activation events described above.

The controller may be configured to activate the intervention system in response to a single activation event or a plurality of activation events, for example, but not exclusively, one or more of the activation events described above.

As described above, the tool housing is configured to house one or more intervention tool for deployment into the wellbore.

In particular embodiments, the tool housing may comprise a lubricator.

The tool housing may be configured for location on, or may form part of, a wellhead.

In embodiments where the tool housing is adapted for location on the wellhead, the intervention system, e.g. the tool housing, may comprise a coupling arrangement for coupling the tool housing, e.g. the lubricator, to the wellhead.

In particular embodiments, the tool housing may be configured for location on a well valve arrangement, in particular but not exclusively a Christmas tree, disposed on the wellhead.

The intervention system may be configured to prevent fluid communication between the tool housing and the wellbore.

The intervention system may be configured to prevent fluid communication between the tool housing and the wellhead and/or the well valve arrangement when the intervention system defines the tool storage configuration and may be configured to permit fluid communication between the tool housing and the wellhead and/or the well valve arrangement when the intervention system defines the activated configuration.

The intervention system may comprise, may be operatively associated with, or may be coupled to, a valve arrangement. The valve arrangement may form part of the tool housing e.g. lubricator. The valve arrangement may be configured to prevent fluid communication between the tool housing and the wellbore, wellhead and/or the well valve arrangement (e.g. Christmas tree) when the intervention system defines the tool storage configuration. The valve arrangement may be configured to permit fluid communication between the tool housing and the wellhead and/or the well valve arrangement (e.g. Christmas tree) when the intervention system defines the activated configuration.

The valve arrangement may comprise a single valve. However, in particular embodiments, the valve arrangement may comprise a plurality of valves. In some embodiments, the valve arrangement may comprise two valves. In some embodiments, the valves arrangement may comprise three valves. The valves may be disposed in series. Beneficially, the provision of a valve arrangement comprising a plurality of valves in series provides at least a double barrier between the wellbore and the tool housing to ensure well integrity is maintained. Embodiments of the intervention system may thus permit a top valve of the well valve arrangement, e.g. the Christmas tree, to be maintained in an open position. This may permit the intervention system to interact with and/or have control over part or all of the well valve arrangement, such as a choke valve or the like, and/or control production from the well.

The valve arrangement may be configured to move between a closed configuration and an open configuration. The intervention system may define the tool storage configuration when the valve arrangement defines the closed configuration. The intervention system may define the activated configuration when the valve arrangement defines the open configuration.

The valve arrangement may be biased to the closed configuration. Beneficially, embodiments of the intervention system may be biased to the closed configuration to provide fail-safe operation. The controller may control operation of the valve arrangement. In some embodiments, the valve arrangement may comprise an independent control arrangement, such as an independent programmable logic controller.

As described above, the tool deployment arrangement is configured to deploy the intervention tool into the wellbore.

The intervention system may permit the intervention tool to be pumped into the wellbore under pressure.

The intervention system may permit the intervention tool to drop into the wellbore under the influence of its weight.

The tool deployment arrangement may comprise an automatic tool deployment arrangement.

The tool deployment arrangement may comprise a conveyance for transporting the intervention tool into and/or retrieving the intervention tool from the wellbore.

The conveyance may comprise a conductor line.

The conveyance may comprise a wireline.

The conveyance may comprise an E-line.

The conveyance may comprise a slickline.

The conveyance may comprise coiled tubing.

The intervention system may comprise a sealing system. The sealing system may be operatively associated with the conveyance. The sealing system may be disposed between the tool housing and the conveyance. In use, the sealing system may be configured to prevent leakage between the tool housing and the conveyance. Beneficially, the sealing system ensures that well control is maintained.

The tool deployment arrangement may comprise a winch. The winch may be configured to pay out and/or reel in the conveyance, e.g. the wireline.

In some embodiments, the winch may be disposed on the tool housing.

In other embodiments, the winch may be located on the ground, on a vehicle, a platform, a support arrangement of the intervention system or other location remote from the tool housing.

The tool deployment arrangement may comprise a pulley. In particular embodiments, the tool deployment arrangement may comprise a plurality of pulleys. The pulleys may be used to guide the conveyance between the winch and the tool housing to facilitate deployment and/or retrieval of the intervention tool into the wellbore.

The intervention system may comprise, may be operatively associated with, or may be provided in combination with, a drive arrangement. The drive arrangement may comprise a motor. The drive arrangement may comprise an electric motor. The drive arrangement may comprise a direct drive electric motor. The drive arrangement may comprise a worm drive.

The intervention system may be self-supporting, that is the intervention system may not require external support during operation, such as from an intervention vehicle, wireline truck or the like.

The intervention system may comprise a support arrangement.

The support arrangement may comprise a support mast.

The winch may be disposed on the support arrangement.

The intervention system may comprise a monitoring arrangement.

The monitoring arrangement may be configured to obtain information relating to a condition in the wellbore.

The monitoring arrangement may comprise a sensor arrangement.

The sensor arrangement may comprise a sensor. The sensor may comprise a plurality of sensors.

The sensor, or at least one of the sensors, may comprise a flow sensor.

The sensor, or at least one of the sensors, may comprise a pressure sensor.

The monitoring arrangement may be configured to obtain information relating to a condition of the intervention system.

The monitoring arrangement may comprise a visual monitoring system.

For example, the monitoring arrangement may comprise a camera system.

The camera system may comprise a camera for monitoring the condition of the conveyance. The camera may be disposed on the support arrangement.

The intervention system may comprise a communication arrangement. The communication arrangement may communicate the information obtained by the monitoring arrangement to a remote location. The communication arrangement may communicate with and transmit data from the monitoring arrangement. The communication arrangement may comprise a transmitter configured to transmit information wirelessly. Alternatively or additionally, the communication arrangement may comprise a transmitter configured to transmit information via wired communication, optical communication or other suitable means for transmission.

The remote location may comprise at least one of a vessel, a buoy, a platform or a rig. Alternatively, or in addition, the remote location may comprise an onshore facility, control room or the like.

The communication arrangement may comprise a satellite communication system. In use, information obtained by the monitoring arrangement may be transmitted to the remote location via satellite.

The communication arrangement may be configured to receive information instructing a change in the status of the intervention system. For example, the communication arrangement may be configured to receive information instructing that the system turn off, turn on and/or enter a stand-by or hibernation state.

The intervention system may comprise a receiver.

The intervention system may comprise a power supply for supplying to the intervention system.

In particular embodiments, the power supply may comprise one or more battery. Beneficially, the use of a battery permits the environmental impact of the intervention system to be reduced.

The power supply may comprise one or more rechargeable battery.

The intervention system may comprise an energy capture device arrangement.

The energy capture device arrangement may comprise one or a plurality of energy capture devices.

In particular embodiments, the energy capture device may comprise a solar energy capture device, such as a solar cell arrangement comprising one or more solar cell. In other embodiments, the energy capture device may comprise a wind energy capture device, such as a wind turbine.

The energy capture device arrangement may be configured to supply power to the intervention system.

The energy capture device arrangement may be configured to supply power to the power supply of the intervention system.

The energy capture device arrangement may recharge the power supply.

According to a second aspect, there is provided a well system comprising: the intervention system of the first aspect; and a wellbore.

The well system may comprise a wellhead valve arrangement. The wellhead valve arrangement may be disposed on a wellhead of the wellbore. In particular embodiments, the wellhead valve arrangement may comprise a Christmas tree.

The intervention system may be configured for coupling to the wellhead valve arrangement.

The tool housing may be configured for coupling to the wellhead valve arrangement. The tool housing may be disposed on top of the wellhead valve arrangement.

The intervention system may include the wellhead valve arrangement.

The well system may comprise a plurality of wellbores.

The well system may comprise a plurality of intervention systems. An intervention system may be provided for at least one of the plurality of wellbores. In particular embodiments, an intervention system may be provided for each of the plurality of wellbores.

According to a third aspect, there is provided a method comprising: providing an intervention system for a wellbore, the intervention system comprising: a tool housing configured to house an intervention tool for deployment into the wellbore; a tool deployment arrangement for deploying the intervention tool into the wellbore, wherein the intervention system is configurable between a tool storage configuration in which the tool housing is isolated from the wellbore and an activated configuration in which the tool housing communicates with the wellbore and permits deployment of the intervention tool by the tool deployment arrangement; and a controller configured to permit autonomous control of operation of the intervention system between the tool storage configuration and the activated configuration to facilitate deployment of the intervention tool into the wellbore; activating the intervention system from the tool storage configuration to the activated configuration; and operating the tool deployment arrangement to deploy the intervention tool into the wellbore.

The intervention system may be activated from the tool storage configuration to the activated configuration in response to a given activation event.

The activation event may take a number of different forms.

The activation event may relate to fluid flow. The fluid flow rate may comprise production flow rate for example.

In particular embodiments, the activation event may comprise a fluid flow rate dropping below a selected threshold. The intervention system may for example be activated in response to the production flow rate from the well dropping below a threshold in order to increase production from a well. Beneficially, such operations can be carried out autonomously and without the requirement to repeatedly transport personnel and equipment to/from site, reducing the costs and challenges associated with the intervention operation and environmental impact on the surrounding environment, wildlife and infrastructure.

The activation event may comprise a fluid flow rate reaching or exceeding a selected threshold.

The activation event may comprise a fluid flow rate decrease. The activation event may comprise a fluid flow rate dropping below a selected threshold.

The activation event may comprise a time event. For example, the intervention system may be configured to activate after a selected time has elapsed, or at a given time of day. Beneficially, embodiments of the intervention system may permit an intervention operation schedule to be implemented autonomously and without the requirement to repeatedly transport personnel and equipment to/from site, reducing the costs and challenges associated with the intervention operation and environmental impact on the surrounding environment and wildlife.

The activation event may comprise a pressure event.

The pressure event may comprise a differential pressure.

In particular embodiments, the activation event may comprise a pressure, such as differential pressure, reaching or exceeding a selected threshold.

In some embodiments, the activation event may comprise a pressure, such as differential pressure, dropping below a selected threshold.

The activation event may comprise a temperature event.

In particular embodiments, the activation event may comprise a temperature reaching or exceeding a selected threshold.

In some embodiments, the activation event may comprise a temperature dropping below a selected threshold.

The intervention system may be activated in response to a single activation event or a plurality of activation events, for example, but not exclusively, one or more of the activation events described above.

The method may comprise monitoring whether the activation event has occurred. The method may comprise using a monitoring arrangement of the intervention system to monitor whether the activation event has occurred.

Activating the intervention system from the tool storage configuration to the activated configuration may comprise operating a valve arrangement forming part of, operatively associated with, or coupled to, the intervention system between a closed configuration and an open configuration. In the closed configuration, the valve arrangement may prevent fluid communication between the tool housing and the wellbore. In the open configuration, the valve arrangement may permit fluid communication between the tool housing and the wellbore.

The valve arrangement may comprise a single valve. However, in particular embodiments, the valve arrangement may comprise a plurality of valves. The valves may be disposed in series.

The method may comprise operating a first valve of the plurality of valves between a closed configuration and an open configuration.

The method may comprise operating a second valve of the plurality of valves between a closed configuration and an open configuration.

The method may comprise monitoring the intervention system after the first valve has been moved to the open configuration before opening the second valve.

The method may comprise communicating the information obtained by the monitoring arrangement.

The method may comprise communicating the information relating to the intervention system using a communication arrangement. The method may comprise communicating the information relating to the intervention system to a remote location using the communication arrangement.

The method may comprise monitoring the intervention system after the second valve has been moved to the open configuration.

The method may comprise communicating the information obtained by the monitoring arrangement. The method may comprise communicating the information relating to the intervention system using the communication arrangement. The method may comprise communicating the information relating to the intervention system to the remote location using the communication arrangement.

The method may comprise monitoring the intervention system after the second valve has been moved to the open configuration before deploying the intervention tool.

The method may comprise communicating the information obtained by the monitoring arrangement. The method may comprise communicating the information relating to the intervention system using the communication arrangement. The method may comprise communicating the information relating to the intervention system to the remote location using the communication arrangement.

The method may comprise running the intervention tool into the wellbore.

The method may comprise performing an intervention operation in the wellbore.

The method may comprise retrieving the intervention tool from the wellbore.

The method may comprise retrieving the intervention tool into the tool housing.

The method may comprise operating the second valve between the open configuration and the closed configuration after the intervention tool has been retrieved from the wellbore.

The method may comprise monitoring the intervention system after the second valve has been moved to the closed configuration. The method may comprise communicating the information obtained by the monitoring arrangement. The method may comprise communicating the information relating to the intervention system using a communication arrangement. The method may comprise communicating the information relating to the intervention system to the remote location using the communication arrangement.

The method may comprise operating the first valve between the open configuration.

The method may comprise monitoring the intervention system after the first valve has been moved to the closed configuration.

The method may comprise venting well pressure from the tool housing.

According to a fourth aspect, there is provided a method comprising: deploying an intervention tool of a wellbore intervention system into a wellbore to perform a first intervention operation on the wellbore; retrieving the intervention tool from the wellbore; and producing from the wellbore, wherein the intervention system remains coupled to the wellbore during production.

The method may comprise deploying the intervention tool into the wellbore to perform a second intervention operation on the wellbore.

Beneficially, the intervention system may be stationed during construction and/or commissioning of the wellbore and may be retained in place for the operational life of the wellbore; obviating or at least mitigating the need to transport intervention equipment to site and thereby minimizing disruption to the local environment, wildlife and infrastructure.

Prior to deploying the intervention tool, the method may comprise activating the wellbore intervention system from a tool storage configuration in which the intervention system is isolated from the wellbore to an activated configuration in which the wellbore intervention system communicates with the wellbore and permits deployment of the intervention tool into the wellbore.

Prior to producing from the wellbore, the method may comprise reconfiguring the intervention system from the activated configuration to the tool storage configuration.

The method may comprise the step of coupling the intervention system to the wellbore. The intervention system may be coupled to a wellhead of the wellbore, either directly or as in particular embodiments via a well valve arrangement, such as a Christmas tree.

The intervention system may comprise a permanent installation. Alternatively, the intervention system may comprise a semi-permanent installation. For example, the intervention system may be retained in place for one or more phases of the operational life of the wellbore.

The intervention system may comprise an intervention system according to the first aspect.

According to another aspect, there is provided a processing system configured to implement one or more of the previous aspects.

The processing system may comprise at least one processor. The processing system may comprise and/or be configured to access at least one data store or memory. The data store or memory may comprise or be configured to receive operating instructions or a program specifying operations of the at least one processor. The at least one processor may be configured to process and implement the operating instructions or program.

The at least one data store may comprise, and/or comprise a reader, drive or other means configured to access, optical storage or disk such as a CD or DVD, flash drive, SD device, one or more memory chips such as DRAMs, a network attached drive (NAD), cloud storage, magnetic storage such as tape or magnetic disk or a hard-drive, and/or the like.

The processing system may comprise a network or interface module. The network or interface module may be connected or connectable to a network connection or data carrier, which may comprise a wired or wireless network connection or data carrier, such as a data cable, powerline data carrier, Wi-Fi, Bluetooth, Zigbee, internet connection or other similar connection. The network interface may comprise a router, modem, gateway and/or the like. The system or processing system may be configured to transmit or otherwise provide the audio signal via the network or interface module, for example over the internet, intranet, network or cloud.

The processing system may comprise a processing apparatus or a plurality of processing apparatus. Each processing apparatus may comprise at least a processor and optionally a memory or data store and/or a network or interface module. The plurality of processing apparatus may communicate via respective network or interface modules. The plurality of processing apparatus may form, comprise or be comprised in a distributed or server/client based processing system.

According to another aspect, there is provided a computer program product configured such that when processed by a suitable processing system configures the processing system to implement one or more of the previous aspects.

The computer program product may be provided on or comprised in a carrier medium. The carrier medium may be transient or non-transient. The carrier medium may be tangible or non-tangible. The carrier medium may comprise a signal such as an electromagnetic or electronic signal. The carrier medium may comprise a physical medium, such as a disk, a memory card, a memory, and/or the like.

According to another aspect, there is provided a carrier medium, the carrier medium comprising a signal, the signal when processed by a suitable processing system causes the processing system to implement one or more of the previous aspects.

It will be well understood by persons of ordinary skill in the art that whilst some embodiments may implement certain functionality by means of a computer program having computer-readable instructions that are executable to perform the method of the embodiments. The computer program functionality could be implemented in hardware (for example by means of a CPU or by one or more ASICs (application specific integrated circuits)) or by a mix of hardware and software.

Whilst particular pieces of apparatus have been described herein, in alternative embodiments, functionality of one or more of those pieces of apparatus can be provided by a single unit, processing resource or other component, or functionality provided by a single unit can be provided by two or more units or other components in combination. For example, one or more functions of the processing system may be performed by a single processing device, such as a personal computer or the like, or one or more or each function may be performed in a distributed manner by a plurality of processing devices, which may be locally connected or remotely distributed.

It should be understood that the features defined above or below may be utilized, either alone or in combination, with any other defined feature.

BRIEF DESCRIPTION OF THE DRAWINGS

These and other aspects will now be described, by way of example only, with reference to the accompanying drawings, in which.

DETAILED DESCRIPTION OF THE INVENTION

Figure 1:
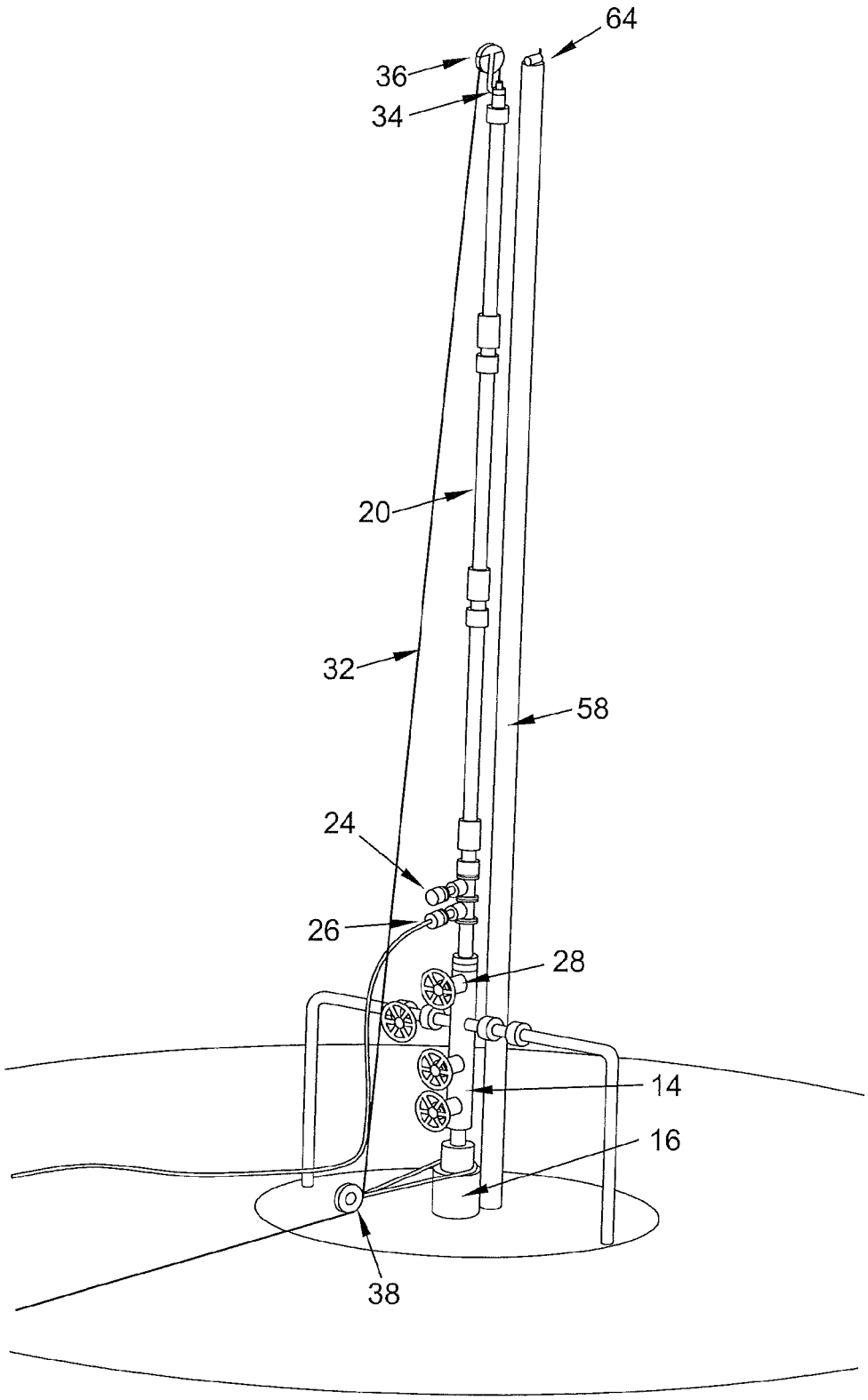
FIGS. 1 and 2 show an intervention system according to a first embodiment.
Figure 2:
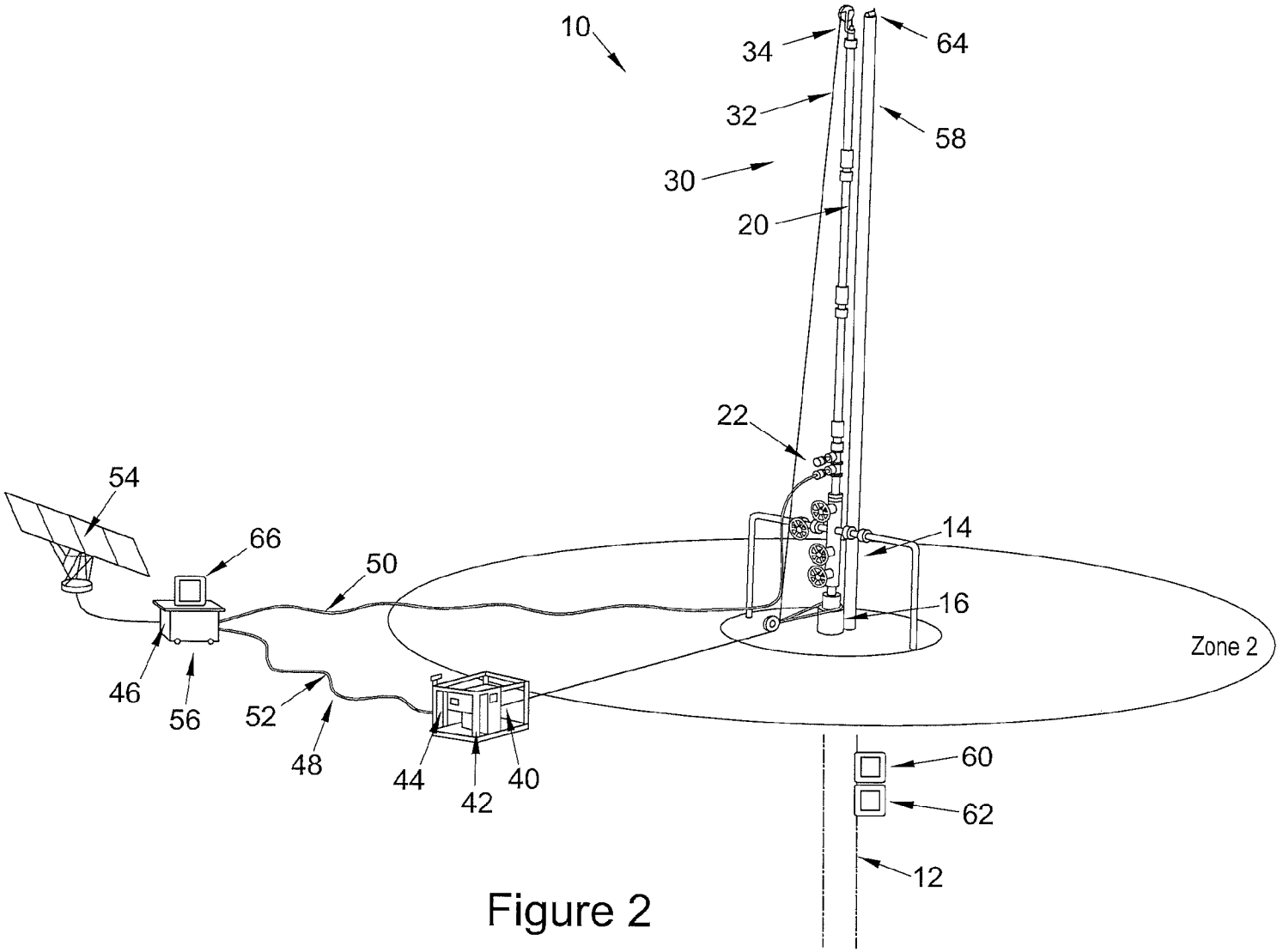

Referring first to FIGS. 1 to 2 of the accompanying drawings, there is shown an intervention system 10, the intervention system 10 configured to perform an intervention operation in a wellbore 12.

In the illustrated embodiment, the wellbore 12 is land-based having a wellhead valve arrangement in the form of a Christmas tree 14 disposed on a wellhead 16.

Figure 6:
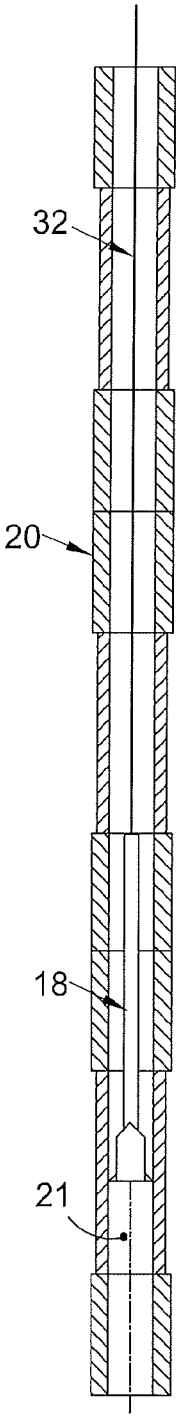
FIG. 6 shows a cut-away view of a tool housing of the intervention system, showing an intervention tool of the intervention system shown in FIGS. 1 and 2.

The intervention system 10 is configured to deploy an intervention tool 18 (shown in FIG. 6) into the wellbore 12 and in the illustrated embodiment the intervention tool 18 comprises a paraffin wax removal tool for cleaning paraffin deposits from the wellbore 12 and associated infrastructure and equipment. However, it will be recognized that the intervention system 10 may be configurable to perform a number of different intervention operations using a suitable intervention tool.

As shown in FIGS. 1 and 2, the intervention system 10 comprises a tool housing in the form of a lubricator 20. In the illustrated embodiment, the lubricator 20 comprises a stand of three connected heavy wall tubing sections, the interior of the lubricator 20 defining a tool storage compartment 21 (shown in FIG. 5) configured to house the intervention tool 18.

As shown in FIGS. 1 and 2, the lubricator 20 is coupled to and disposed on top of the Christmas tree 14. A valve arrangement 22—which in the illustrated embodiment forms part of the lubricator 20—permits selective communication of tools and fluid between the lubricator 20 and the Christmas tree 14 (or between the lubricator 20 and the wellbore 12 where no Christmas tree 14 is provided).

Figure 3:
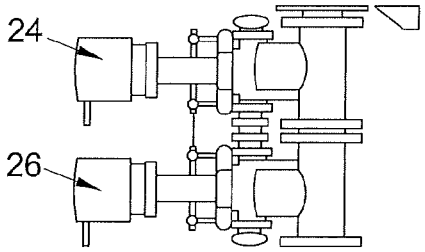
FIG. 3 shows an enlarged view of a valve arrangement of the intervention system shown in FIGS. 1 and 2.

As shown in FIGS. 2 and 3, the valve arrangement 22 has an upper control valve 24 and a lower control valve 26. In the illustrated embodiment, the valve arrangement 22 has an upper valve 24 and a lower valve 26 which can be controlled independently. The valve arrangement 22 provides a dual barrier between the lubricator 20 and the wellhead valve arrangement 14, and permits an upper valve 28 of the Christmas tree 14 to be maintained in an open condition.

The intervention system 10 is configurable between a tool storage configuration in which the tool housing 20 is isolated from the wellbore 12 by the valve arrangement 22 and an activated configuration in which the valve arrangement 22 is open and the tool housing 20 communicates with the Christmas tree 14 and the wellbore 12 to permit deployment of the intervention tool 18 by a tool deployment arrangement 30, as will be described below.

Figure 4:
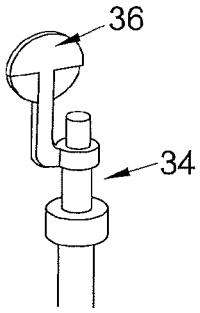
FIG. 4 shows an enlarged view of a stuffing box of the intervention system shown in FIGS. 1 and 2.
Figure 5:
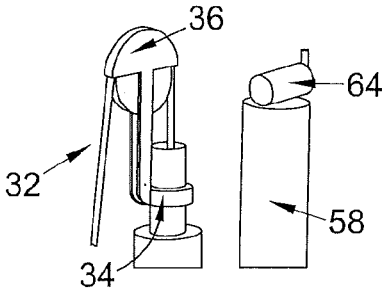
FIG. 5 shows an enlarged view of part of a monitoring arrangement of the intervention system shown in FIGS. 1 and 2.

The tool deployment arrangement 30 is provided for deploying the intervention tool 18 into the wellbore 12. The tool deployment arrangement 30 comprises a conveyance in the form of wireline 32 which is coupled to the intervention tool 18 and which extends through an upper end portion of the lubricator 20 via stuffing box 34—in the illustrated embodiment a dual chamber stuffing box—to ensure pressure integrity of the tool housing 20 and monitors any fluid/gas wire bypass. An enlarged view of the stuffing box 34 is shown in FIGS. 4 and 5.

The tool deployment arrangement further comprises pulleys 36,38 for supporting the wireline 32. In the illustrated embodiment shown in FIG. 1, pulley 36 is disposed on the tool housing 20 above the stuffing box 34 and pulley 38 is tied to wellhead 16, although it will be recognized that the pulleys 36,38 may be disposed at other suitable locations.

A winch 40 is provided and is operatively coupled to a drive 42 which in the illustrated embodiment takes the form of a direct drive electric motor. In use, the drive 42 rotates the winch 40 in order to pay out the wireline 32 when it is desired to deploy the intervention tool 18 into the wellbore 12 and reel in the wireline 32 when it is desired to retrieve the intervention tool 18 from the wellbore 12.

As shown in FIG. 2, in the illustrated embodiment a control desk 44 permits manual interface with the intervention system 10 by an onsite operative, where desired.

A power supply arrangement which in the illustrated embodiment takes the form of a battery unit 46 supplies power to the system 10. Power conduit 48 supplies power from the battery unit 46 to the drive 42 and winch 40. Power conduit 50 supplies power from the battery unit 46 to the valve arrangement 22. Power to the power supply arrangement 46 in the illustrated embodiment is provided by an energy capture arrangement—represented generally by 52—including an energy capture device which in the illustrated embodiment takes the form of a solar panel 54.

The intervention system 10 further comprises a controller 56 in the form of a programmable logic controller (PLC) configured to permit autonomous control of operation of the intervention system 10. It will be recognized that the controller 56, or parts of the controller 56, may be located at any suitable location, for example but not exclusively on the lubricator 20 or at the wellhead 16.

A support arrangement in the form of support mast 58 supports the Christmas tree 14 and the lubricator 20.

A monitoring arrangement is provided. In the illustrated embodiment, the monitoring arrangement comprises a flow sensor 60 and a pressure sensor 62. However, it will be recognized that in other embodiments the intervention system 10 may comprise one or other of the flow sensor 60 and the pressure sensor 62, or other sensors alone or in combination. The monitoring arrangement also comprises a visual monitoring system in the form of a camera 64 which in the illustrated embodiment is disposed on the support mast 58. In use, the camera 64 facilitates remote visual monitoring of the tool deployment arrangement.

A communication arrangement—in the illustrated embodiment a transceiver 66—is provided for communicating information to a remote location 68 either directly or as shown via satellite 70. In use, the transceiver 66 communicates information obtained by the monitoring arrangement to the remote location 68. In the illustrated embodiment, the transceiver 66 is configured for two-way communication; permitting commands to be sent to the intervention system 10.

Operation of the intervention system 10 will now be described with reference to FIGS. 1 to 7 of the accompanying drawings.

The intervention system 10 is initially disposed in the tool storage configuration with the intervention tool 18 disposed in the tool storage compartment 21 of the lubricator 20. In this configuration, the upper and lower control valves 24,26 are configured in their closed configurations, thereby providing a dual barrier between the lubricator 20 and the Christmas tree 14/wellbore 12. As described above, the provision of the dual barrier beneficially permits the upper control valve 28 of the Christmas tree 14 to be maintained in an open configuration.

Figure 7:
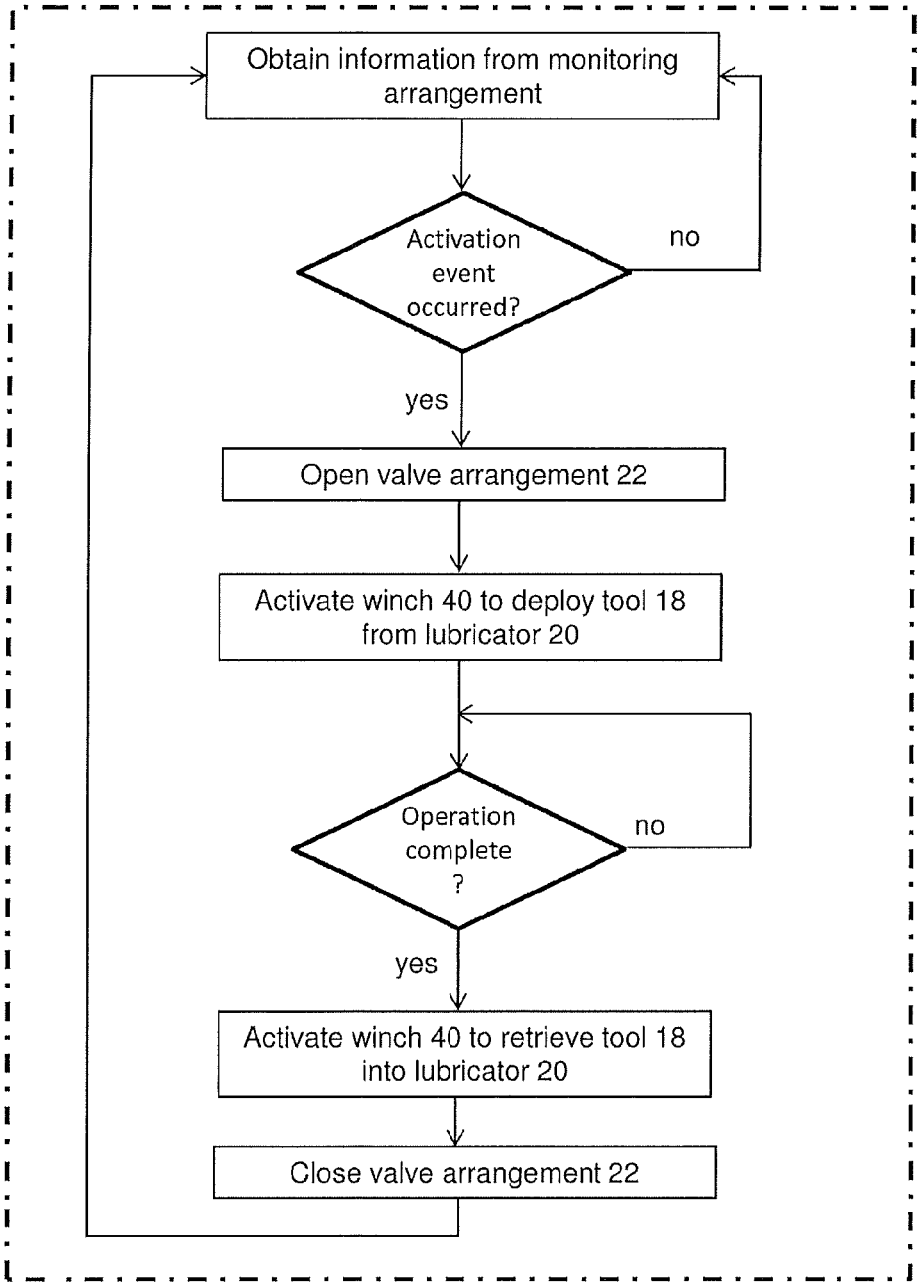
FIG. 7 shows a flowchart of an intervention method using the intervention system shown in FIGS. 1 and 2.

As illustrated in FIG. 7, on identifying that an activation event has occurred (e.g. the sensor detecting that the well flow rate has dropped below a threshold valve) the controller 56 will reconfigure the intervention system 10 from the well storage configuration to the activated configuration to permit deployment of the intervention tool 18 into the wellbore 12 by opening the lower and upper control valves 24,26.

In the illustrated embodiment, the lower control valve 26 is opened first and then the upper control valve 24. However, it will be recognized that in some instances the upper control valve 26 may be opened first or the valves may be opened simultaneously.

The monitoring arrangement monitors the intervention system to ensure that the control valves 24, 26 have opened correctly and that pressure integrity has been maintained.

The controller 56 then activates the electric motor and winch of the tool deployment arrangement to pay out the wireline and deploy the intervention tool 18 into the wellbore 12 to perform the intervention operation.

In the illustrated embodiment, the intervention operation comprises running a paraffin wax removal tool into the wellbore 12 to remove paraffin wax deposits from the wellbore 12 and associated infrastructure and equipment.

On completion of the intervention operation, the controller 56 activates the electric motor and winch of the tool deployment arrangement to reel in the wireline and the coupled intervention tool 18 until the intervention tool 18 has been retrieved into the lubricator 20.

The controller 56 then reconfigures the intervention system 10 from the activated configuration to the tool storage configuration by closing the upper and lower control valves 24,26.

Well pressure may then be vented from the lubricator 20.

It should be understood that embodiments described herein are merely exemplary and that various modifications may be made thereto without departing from the scope of the invention.

For example, and referring now to FIGS. 8 to 14 of the accompanying drawings, there is shown an intervention system 110 according to a second embodiment. The intervention system 110 is similar to the intervention system 10 and like components of the system 110 to those of the system 10 are represented by like numerals incremented by 100.

As in the intervention system 10, the intervention system 110 is configured to permit an intervention operation to be carried out on a wellbore 112, the wellbore 112 also being land-based and having a wellhead valve arrangement in the form of a Christmas tree 114 disposed on wellhead 116.

The intervention system 110 is configured to deploy an intervention tool 118 (shown in FIG. 13) into the wellbore 112 and in the illustrated embodiment the intervention tool 118 comprises a paraffin wax removal tool for cleaning paraffin deposits from the wellbore 112 and associated infrastructure and equipment. However, it will be recognized that the intervention system 110 may be configurable to perform a number of different intervention operations using a suitable intervention tool.

Figure 8:
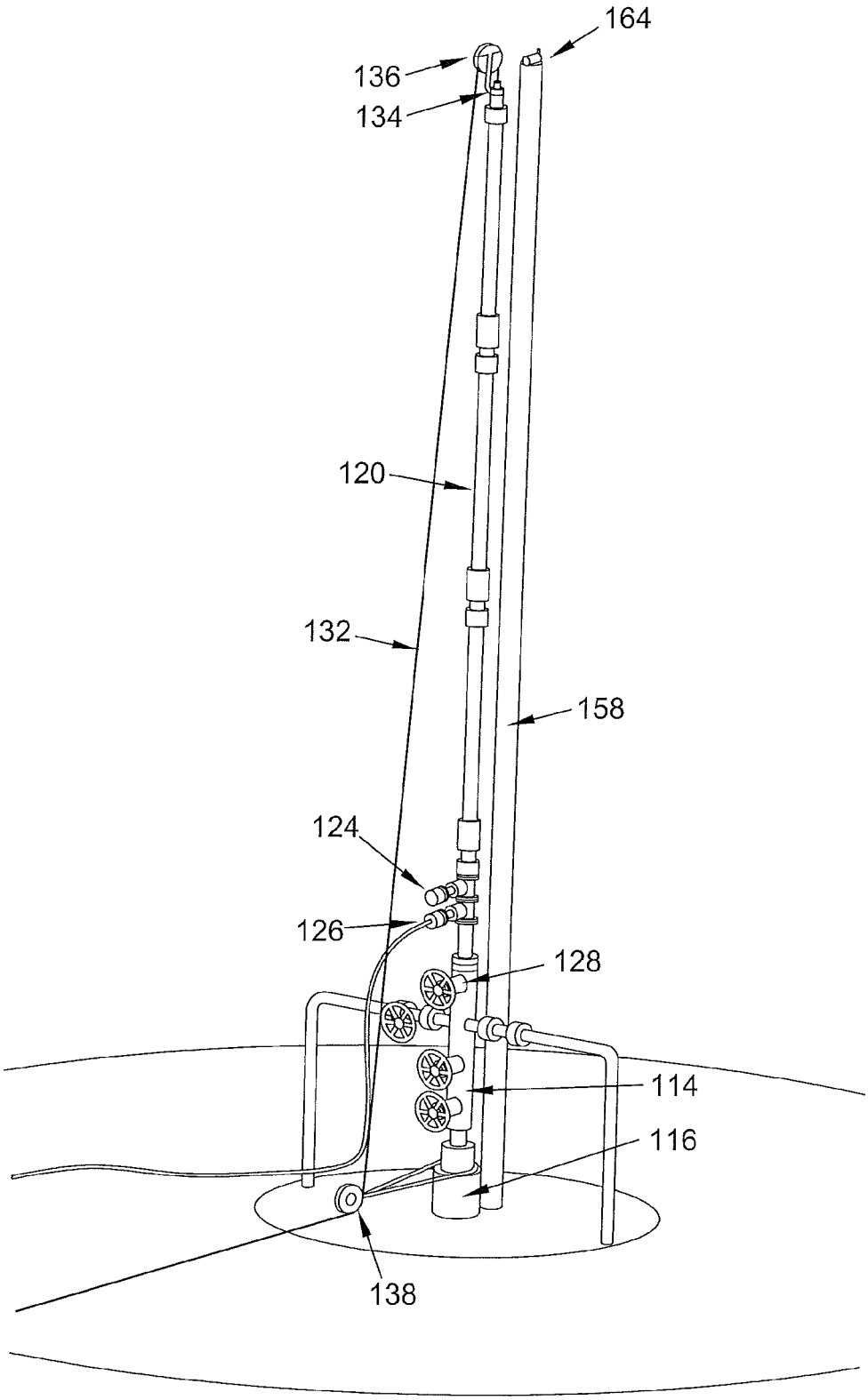
FIGS. 8 and 9 show an intervention system according to a second embodiment.

As in the intervention system 10, the intervention system 110 comprises a tool housing in the form of a lubricator 120. In the illustrated embodiment, the lubricator 120 comprises a stand of three connected heavy wall tubing sections, the interior of the lubricator 120 defining a tool storage compartment 121 (shown in Figure) configured to house the intervention tool 118. As shown in FIG. 8, the lubricator 120 is coupled to and disposed on top of the Christmas tree 114.

A valve arrangement 122—which in the illustrated embodiment forms part of the lubricator 120—permits selective communication of tools and fluid between the lubricator 120 and the Christmas tree 114 (or between the lubricator 120 and the wellbore 112 where no Christmas tree 114 is provided).

Figure 9:
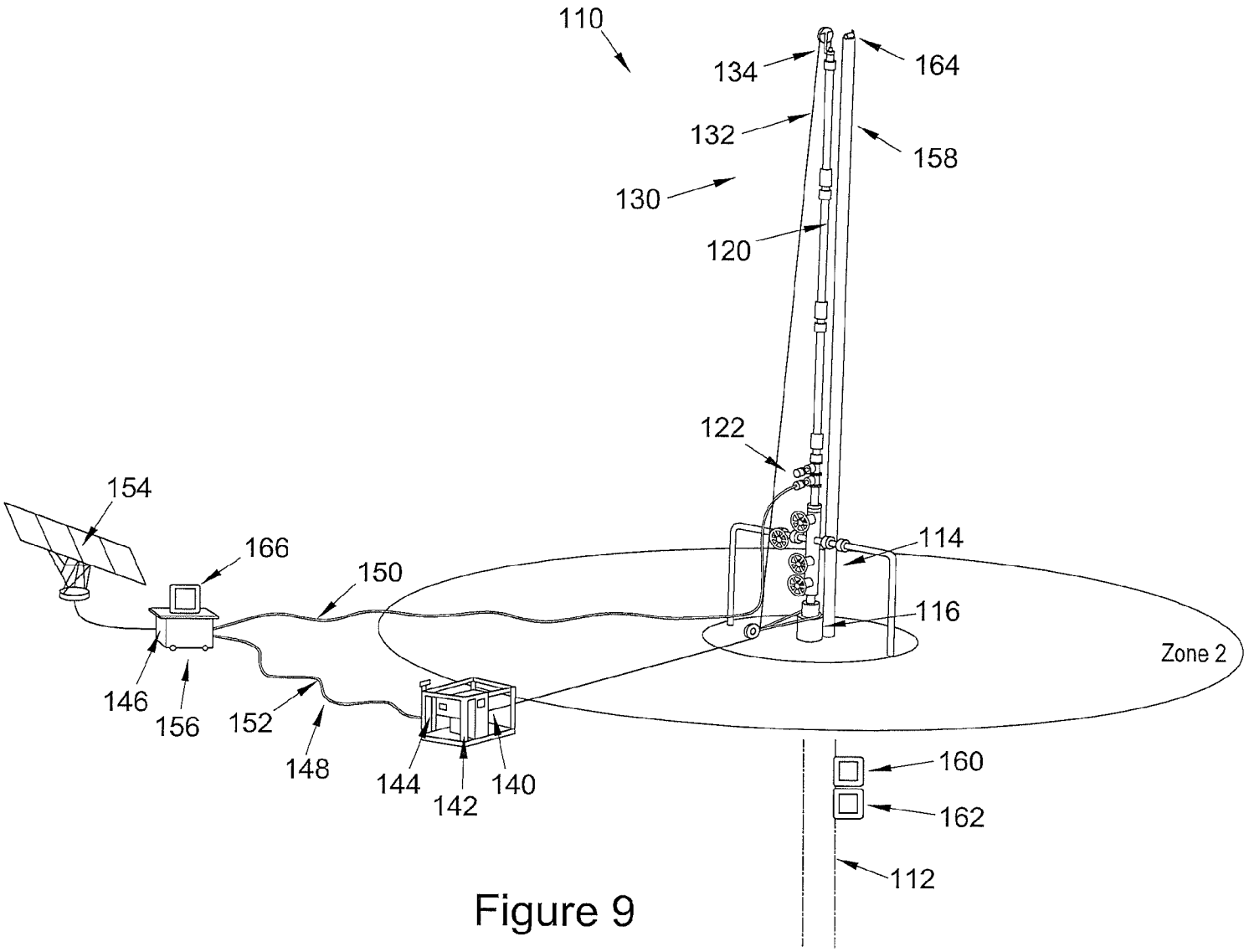
Figure 10:
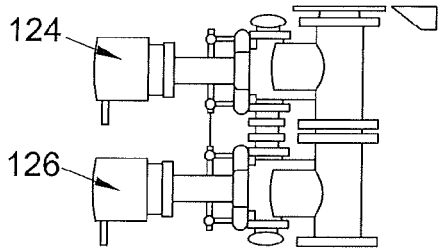
FIG. 10 shows an enlarged view of a valve arrangement of the intervention system shown in FIGS. 8 and 9.

As shown in FIGS. 9 and 10, the valve arrangement 122 has an upper control valve 124 and a lower control valve 126. In the illustrated embodiment, the valve arrangement 122 has an upper valve 124 and a lower valve 126 which can be controlled independently. The valve arrangement 122 provides a dual barrier between the lubricator 120 and the Christmas tree 114, and permits an upper valve 128 of the Christmas tree 114 to be maintained in an open condition.

The intervention system 110 is configurable between a tool storage configuration in which the lubricator 120 is isolated from the wellbore 112 by the valve arrangement 122 and an activated configuration in which the valve arrangement 122 is open and the lubricator 120 communicates with the Christmas tree 114 and the wellbore 112 to permit deployment of the intervention tool 118 by a tool deployment arrangement 130, as will be described below.

Figure 11:
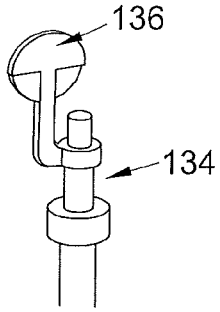
FIG. 11 shows an enlarged view of a stuffing box of the intervention system shown in FIGS. 8 and 9.
Figure 12:
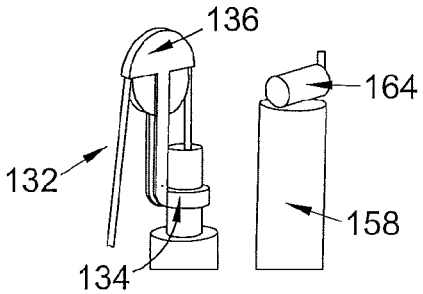
FIG. 12 shows an enlarged view of a winch unit of the intervention system shown in FIGS. 8 and 9.
Figure 13:
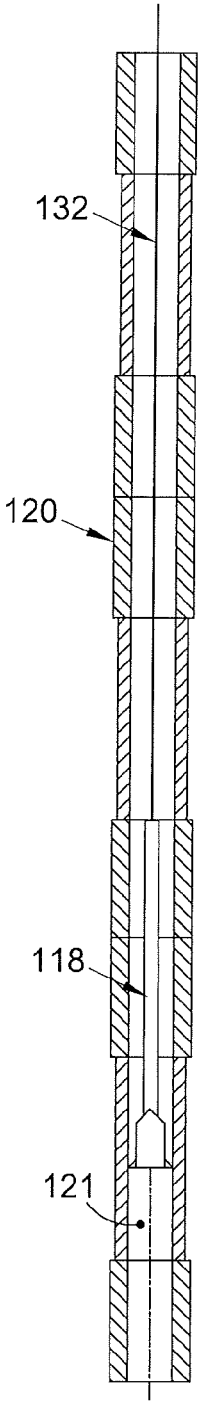
FIG. 13 shows a cut-away view of a tool housing of the intervention system, showing an intervention tool of the intervention system shown in FIGS. 8 and 9.

The tool deployment arrangement 130 is provided for deploying the intervention tool 118 into the wellbore 112. The tool deployment arrangement 130 comprises a conveyance in the form of wireline 132 which is coupled to the intervention tool 118 and which extends through an upper end portion of the lubricator 120 via stuffing box 134—in the illustrated embodiment a dual chamber stuffing box 134—to ensure pressure integrity of the tool housing 20 and monitors any fluid/gas wire bypass. An enlarged view of the stuffing box 134 is shown in FIGS. 11 and 12.

In the intervention system 110, the tool deployment arrangement 130 comprises a single pulley 136 which is disposed on the tool housing 120 above the stuffing box 134.

A winch 140 is provided and is operatively coupled to a drive 142 which in the illustrated embodiment takes the form of a direct drive electric motor. In use, the drive 142 rotates the winch 140 in order to pay out the wireline 132 when it is desired to deploy the intervention tool 118 into the wellbore 112 and reel in the wireline 132 when it is desired to retrieve the intervention tool 118 from the wellbore 112.

In the system 110, it can be seen that the winch 140 and the drive 142 are disposed on the lubricator 120. This provides a more compact system having a smaller footprint than the system 10.

A power supply arrangement which in the illustrated embodiment takes the form of a battery unit 146 supplies power to the system 110. Power conduit 148 supplies power from the battery unit 146 to the drive 142 and winch 140. Power conduit 150 supplies power from the battery unit 146 to the valve arrangement 122. Power to the power supply arrangement 146 in the illustrated embodiment is provided by an energy capture arrangement—represented generally by 152—including an energy capture device which in the illustrated embodiment takes the form of a solar panel 154.

The intervention system 110 further comprises a controller 156 in the form of a programmable logic controller (PLC) configured to permit autonomous control of operation of the intervention system 110. It will be recognized that the controller 156, or parts of the controller 156, may be located at any suitable location, for example but not exclusively on the lubricator 120 or at the wellhead 116.

A monitoring arrangement is provided. In the illustrated embodiment, the monitoring arrangement comprises a flow sensor 160 and a pressure sensor 162. However, it will be recognized that in other embodiments the intervention system 110 may comprise one or other of the flow sensor 160 and the pressure sensor 162, or other sensors alone or in combination.

A communication arrangement—in the illustrated embodiment a transceiver 166—is provided for communicating information to a remote location 168 either directly or as shown via satellite 170. In use, the transceiver 166 communicates information obtained by the monitoring arrangement to the remote location 168. In the illustrated embodiment, the transceiver 166 is configured for two-way communication; permitting commands to be sent to the intervention system 110.

Operation of the intervention system 110 will now be described with reference to FIGS. 8 to 14 of the accompanying drawings.

The intervention system 110 is initially disposed in the tool storage configuration with the intervention tool 118 disposed in the tool storage compartment 121 of the lubricator 120. In this configuration, the upper and lower control valves 124,126 are configured in their closed configurations, thereby providing a dual barrier between the lubricator 120 and the Christmas tree 114/wellbore 112. As described above, the provision of the dual barrier beneficially permits the upper control valve 128 of the Christmas tree 114 to be maintained in an open configuration.

Figure 14:
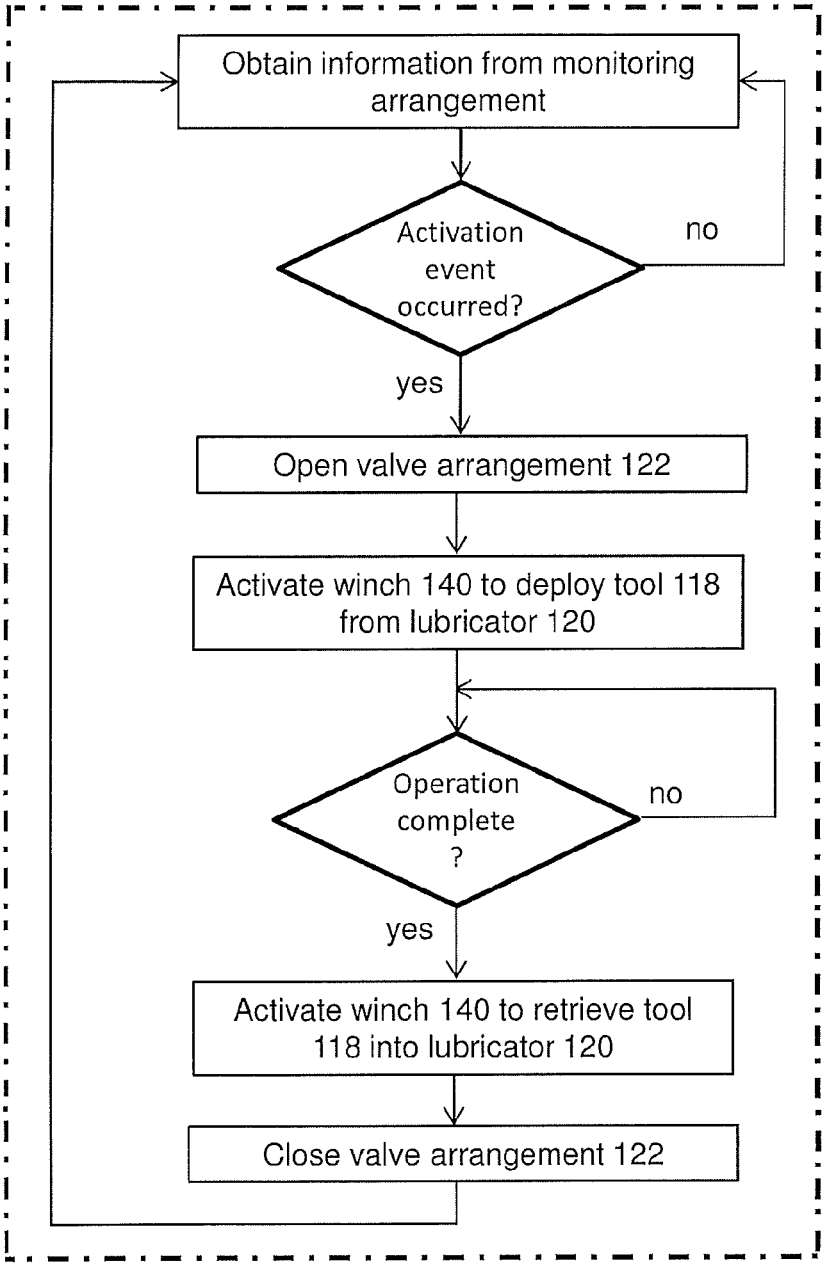
FIG. 14 shows a flowchart of an intervention method using the intervention system shown in FIGS. 8 and 9.

As illustrated in FIG. 14, on identifying that an activation event has occurred (e.g. the sensor 160 detecting that the well flow rate has dropped below a threshold valve) the controller 156 will reconfigure the intervention system 110 from the well storage configuration to the activated configuration to permit deployment of the intervention tool 118 into the wellbore 112 by opening the lower and upper control valves 124,126.

In the illustrated embodiment, the lower control valve 126 is opened first and then the upper control valve 124. However, it will be recognized that in some instances the upper control valve 126 may be opened first or the valves may be opened simultaneously.

The monitoring arrangement monitors the intervention system to ensure that the control valves 124, 126 have opened correctly and that pressure integrity has been maintained.

The controller 156 then activates the electric motor and winch 140 of the tool deployment arrangement 130 to pay out the wireline 132 and deploy the intervention tool 118 into the wellbore 112 to perform the intervention operation.

In the illustrated embodiment, the intervention operation comprises running a paraffin wax removal tool into the wellbore 112 to remove paraffin wax deposits from the wellbore 112 and associated infrastructure and equipment.

On completion of the intervention operation, the controller 156 activates the electric motor and winch 140 of the tool deployment arrangement 130 to reel in the wireline 132 and the coupled intervention tool 118 until the intervention tool 118 has been retrieved into the lubricator 120.

The controller 156 then reconfigures the intervention system 110 from the activated configuration to the tool storage configuration by closing the upper and lower control valves 124,126.

Well pressure may then be vented from the lubricator 120.

Figure 15:
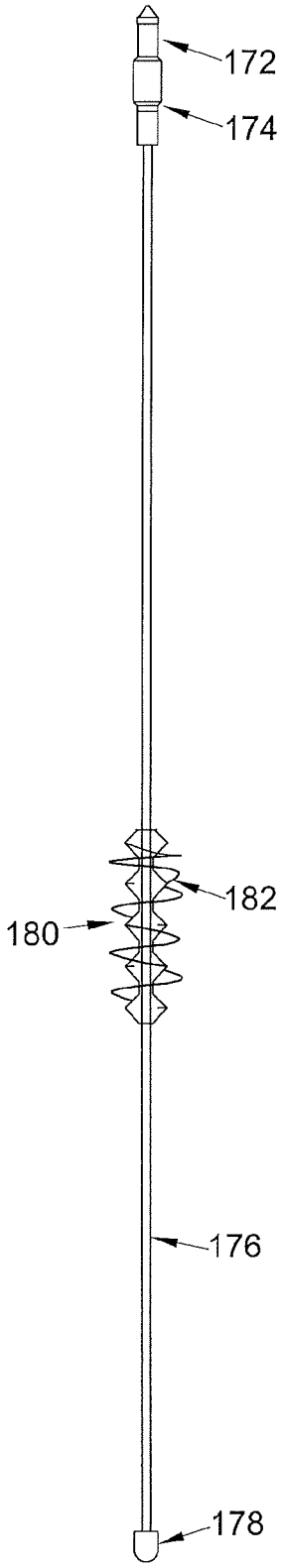
FIG. 15 shows an exemplary intervention tool for use in the intervention system shown in FIGS. 1 and 2 and/or the intervention system shown in FIGS. 8 and 9.

As described above, the intervention systems 110 is configured to deploy and/or retrieve an intervention tool 118 into and/or from the wellbore 112 in order to perform an operation. An exemplary intervention tool 118 is shown in FIG. 15. It will be recognized that the intervention tool 118 may also be used as the intervention tool 18 in the intervention system shown in FIGS. 1 and 2.

As shown, the intervention tool 118 comprises a connector arrangement—which in the illustrated embodiment takes the form of a rope socket 172 and a thread connector 174—for connecting the intervention tool 118 to the wireline 132. The intervention tool 118 further comprises a mandrel 176—in the illustrated embodiment a jar rod—and an end cap 178. A cutter, shown generally at 180, is disposed on the mandrel 176 and is coupled to the mandrel 176 so as to be axially moveable relative to the mandrel 176. In the illustrated embodiment, the cutter 180 comprises one or more wire cutter elements 182. In use, movement of the cutter 180 relative to the mandrel 176 acts to remove paraffin deposits or other solids or residues from the wellbore 112.

Beneficially, embodiments of the intervention system permit wellbore integrity to be managed and production maintained safely and efficiently while at the same time permitting intervention operations, such as paraffin wax cleaning operations for example, to be carried out autonomously. Moreover, embodiments of the intervention system may reduce the environmental impact on the surrounding environment, for example reducing the requirement for large and heavy vehicles; reduce carbon emissions, and noise. Vehicle fleet management and personnel costs may also be reduced.

Figure 16:
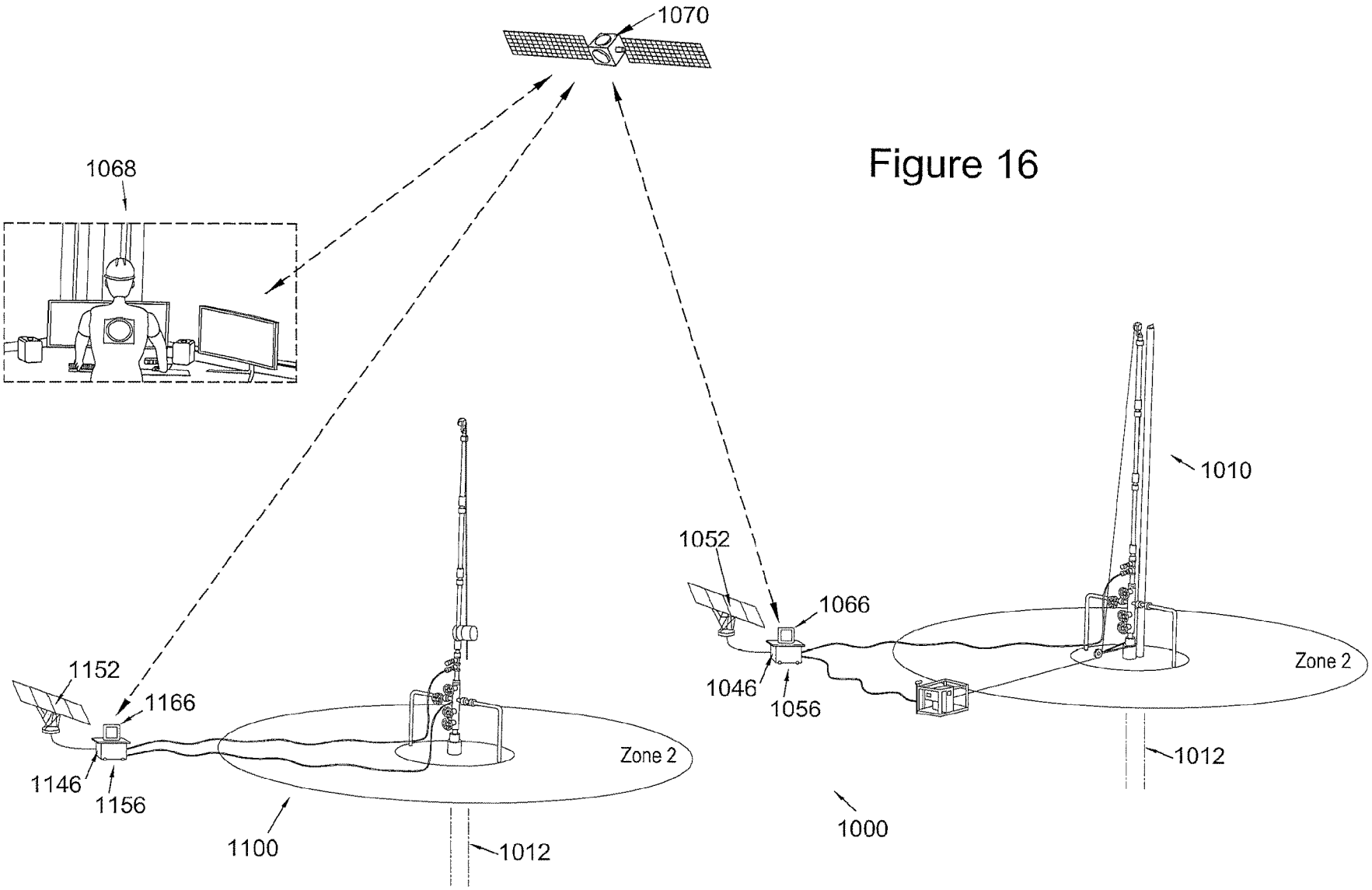
FIG. 16 shows a well system according to an embodiment.

A well system 1010 according to an embodiment is shown in FIG. 16 of the accompanying drawings. As shown, the well system 1000 comprises a plurality of wellbores 1012, a first intervention system 1010 operatively associated with a first of the wellbores 1012 and a second intervention system 1100 operatively associated with a second of the wellbores 1012. The intervention systems 1010, 1110 may be of the same configuration or different configurations. For example, in the illustrated embodiment, the first intervention system 1010 corresponds to the intervention system 10 while the second intervention system 1110 corresponds to the intervention system 110.

In the illustrated embodiment, the intervention systems 1010,1110 each have their own power supply in the form of battery units 1046,1146, controller 1056,1156 and energy capture arrangement 1052,1152. However, it will recognized that the intervention systems 1010,1110—in particular but not exclusively those relating to wellbores from the same field—may be coupled to a common power supply, energy capture arrangement and/or controller.

Similarly, the intervention systems 1010,1110 each have their own communication arrangement 1066,1166 for communicating information to a remote location 1068 either directly or as shown via satellite 1070.

Beneficially, embodiments of the well system 1000 permit wellbore integrity to be managed and production maintained safely and efficiently while at the same time permitting intervention operations, such as paraffin wax cleaning operations for example, to be carried out autonomously. Moreover, embodiments of the well system 1000 may reduce the environmental impact on the surrounding environment, for example reducing the requirement for large and heavy vehicles; reduce carbon emissions, and noise. Vehicle fleet management and personnel costs may also be reduced.

As described above, it should be understood that embodiments described herein are merely exemplary and that various modifications may be made thereto without departing from the scope of the invention.

For example, while in the described embodiments the systems and methods are directed to the removal of paraffin wax from a wellbore and associated infrastructure and equipment, it will be understood that the systems and methods may be used to perform any suitable intervention operation, including not exclusively well logging operations.

What is claimed is:

1. An autonomous intervention system for a wellbore, the intervention system comprising:

a tool housing configured to house an intervention tool for deployment into the wellbore;

a tool deployment arrangement for deploying the intervention tool into the wellbore, wherein the tool deployment arrangement comprises a conveyance for transporting the intervention tool into and/or retrieving the intervention tool from the wellbore and a winch configured to pay out and/or reel in the conveyance, and wherein the intervention system is configurable between a tool storage configuration in which the tool housing is isolated from the wellbore and an activated configuration in which the tool housing communicates with the wellbore and permits deployment of the intervention tool by the tool deployment arrangement; and a controller configured to permit autonomous control of operation of the intervention system between the tool storage configuration and the activated configuration to facilitate deployment of the intervention tool into the wellbore, wherein the controller is configured to activate the intervention system in response to a predetermined activation event, so as to reconfigure the intervention system from the tool storage configuration to the activated configuration.

2. The intervention system of claim 1, wherein the activation event comprises at least one of: a fluid flow rate; a time event; a pressure event; and/or a temperature event.

3. The intervention system of claim 1, wherein the tool housing comprises a lubricator.

4. The intervention system of claim 1, wherein the tool housing is configured for location on a wellhead of the wellbore.

5. The intervention system of claim 1, further comprising a well valve arrangement wherein the well valve arrangement is configured to:

prevent fluid communication between the tool housing and the wellbore and/or a well valve arrangement of the wellbore when the intervention system defines the tool storage configuration; and/or permit fluid communication between the tool housing and the wellbore and/or the well valve arrangement when the intervention system defines the activated configuration.

6. The intervention system of claim 1, wherein the tool deployment arrangement comprises a pulley.

7. The intervention system of claim 1, further comprising, operatively associated with, or provided in combination with, a drive arrangement.

8. The intervention system of claim 7, wherein the drive arrangement comprises an electric motor.

9. The intervention system of claim 1, further comprising a support arrangement, the support arrangement comprising a support mast.

10. The intervention system of claim 1, comprising a monitoring arrangement.

11. The intervention system of claim 10, further comprising a sensor arrangement configured to obtain information relating to a condition in the wellbore and/or a condition of the intervention system.

12. The intervention system of claim 1, further comprising a communication arrangement.

13. The intervention system of claim 1, further comprising a power supply for supplying to the intervention system.

14. The intervention system of claim 13, wherein the power supply comprises comprise one or more battery.

15. The intervention system of claim 1, further comprising an energy capture device arrangement.

16. The intervention system of claim 1, further comprising a sealing system operatively associated with the conveyance, the sealing system configured to prevent leakage between the tool housing and the conveyance.

17. A well system comprising:

the intervention system of claim 1; and a wellbore.

18. A method comprising:

providing an intervention system for a wellbore, the intervention system comprising: a tool housing configured to house an intervention tool for deployment into the wellbore; a tool deployment arrangement for deploying the intervention tool into the wellbore, wherein the tool deployment arrangement comprises a conveyance for transporting the intervention tool into and/or retrieving the intervention tool from the wellbore and a winch configured to pay out and/or reel in the conveyance, and wherein the intervention system is configurable between a tool storage configuration in which the tool housing is isolated from the wellbore and an activated configuration in which the tool housing communicates with the wellbore and permits deployment of the intervention tool by the tool deployment arrangement; and a controller configured to permit autonomous control of operation of the intervention system between the tool storage configuration and the activated configuration to facilitate deployment of the intervention tool into the wellbore;

activating the intervention system from the tool storage configuration to the activated configuration, wherein the controller is configured to activate the intervention system in response to a predetermined activation event, so as to reconfigure the intervention system from the tool storage configuration to the activated configuration; and operating the tool deployment arrangement to deploy the intervention tool into the wellbore.

19. The intervention system of claim 1, wherein the conveyance comprises at least one of: a conductor line; a wireline, an E-Line; a slickline; and coiled tubing.

* * * * *